United States Patent [19]

Caddock, Jr.

[11] Patent Number: 4,766,410

[45] Date of Patent: Aug. 23, 1988

[54] HIGH-VOLTAGE CYLINDRICAL FILM-TYPE RESISTOR AND METHOD OF MAKING IT

[75] Inventor: Richard E. Caddock, Jr., Riverside, Calif.

[73] Assignee: Caddock Electronics, Inc., Riverside, Calif.

[21] Appl. No.: 918,139

[22] Filed: Oct. 14, 1986

[51] Int. Cl.[4] ..... H01C 1/034

[52] U.S. Cl. ..... 338/275; 29/621.1; 338/61; 338/273; 338/274

[58] Field of Search ..... 338/61, 275, 62, 63; 29/610 R, 611, 592 R, 273, 274

[56] References Cited

U.S. PATENT DOCUMENTS 3,858,147 12/1974 Caddock ..... 338/62
4,132,971 1/1979 Caddock, Jr. ..... 338/61

*Primary Examiner*—E. A. Goldberg
*Assistant Examiner*—M. M. Lateef
*Attorney, Agent, or Firm*—Richard L. Gausewitz

[57] ABSTRACT

A high-voltage cylindrical film-type resistor has cup-shaped end caps that receive the ends of the cylindrical substrate, each end cap having a convexly-radiused rim that has a radius of at least 1.5 mils in a plane containing the substrate axis. In accordance with the method, the stated radius is achieved by abrading, preferably tumbling.

16 Claims, 2 Drawing Sheets

HIGH-VOLTAGE CYLINDRICAL FILM-TYPE RESISTOR AND METHOD OF MAKING IT

BACKGROUND OF THE INVENTION

In many applications, including but not limited to electronic circuits used in satellites, it is important to achieve both (1) a high degree of compactness and (2) very long-range (measured in years) reliability despite extremely severe environmental conditions.

Circuit compactness, factor (1) stated above, is not only a function of the physical sizes of the components in the circuit, but is also a function of how far the components must be spaced from each other in order to prevent adverse interactions therebetween. Such size and spacing considerations are especially significant relative to high-voltage resistors—which often seem to be about the last things that circuit designers try to cram into a circuit of given physical size. The smaller the high-voltage resistors, the smaller the spaces into which they can be inserted without causing them to be intolerably close to other circuit components.

As indicated above, smallness of the resistors is not the only thing. Also of major importance is the tendency of high-voltage resistors to generate coronas that can adversely impact not only on adjacent components but on the resistors themselves. Despite the fact that the circuits are conventionally potted in materials, for example epoxy compounds, having high dielectric strengths, the corona discharges from the high-voltage resistors can have devastating and unpredictable consequences.

Factor (2) stated above, namely long-range reliability, is—vis-a-vis high-voltage resistors—largely related to the corona problems. The coronas can cause erratic tunneling through the dielectric from resistors to other circuit elements, or from one part of a resistor to another part thereof. The "tunnels" are minute in diameter, and can grow progressively over time until breakdown occurs.

The corona problem is especially crucial when the high-voltage resistors are incorporated in satellites. The extreme, repeated thermal shocks present in the satellites mean that high-strength dielectrics cannot practically be caused to engage the resistive film material itself. Any such engagement would, because of differences in coefficients of thermal expansion, tend to set up adverse shear forces in the resistive film. Thus, in satellite circuits, as elsewhere, layers of environmentally-protective buffer material (preferably silicone conformal) are placed around the resistive film, buffering it from the surrounding epoxy or other dielectric substance.

SUMMARY OF THE INVENTION

In accordance with the present invention, a high-voltage cylindrical film-type resistor, that has been sold commercially for years, is rendered much less likely to generate harmful coronas. This is accomplished in an article that is no larger than the previously-sold resistor, and by a method that increases its cost only a small amount, and that does not increase the difficulty of press-fitting the end caps onto the resistor cores.

The rim of the cup-shaped metal end cap at each end of the cylindrical core of the resistor, which end cap cooperates with a lead to form an end termination, is caused to be convexly radiused or rounded in longitudinal section instead of having the shape that normally results from the cup-stamping (deep drawing followed by shearing) operation. Such radiusing or rounding greatly reduces corona discharge even though the wall thickness of the cup is, typically, only about 10 mils.

The rounding of the end-cap rim is effected by abrading. Stated more specifically, the rounding is preferably achieved by tumbling. The tumbling is caused to continue for a time period much longer than that which has in the past been required for deburring. Since large numbers of end caps are tumbled at once, even the protracted tumbling operation is inexpensive.

Because both the outer and inner sides of the cup rims are convexly rounded, press-fitting of the resistor cores into the cups is not rendered more difficult than in prior-art methods.

DETAILED DESCRIPTION OF THE PREFERRED EMBODIMENT

Except as specifically stated herein, the present elongated cylindrical film-type resistors are constructed in accordance with U.S. Pat. Nos. 3,858,147 and 4,132,971. The latter patent, U.S. Pat. No. 4,132,971, describes and claims an improvement over the resistor described in U.S. Pat. No. 3,858,147. Thus, the resistor described in U.S. Pat. No. 4,132,971 is the presently-preferred form vis-a-vis everything except corona discharge. The disclosures of both U.S. Pat. Nos. 3,858,147 and 4,132,971 are hereby incorporated by reference herein as though set forth in full.

The end-cap shapes and relationships are the same at both ends of each resistor. Thus, only one end will be described and shown.

Figure 1:
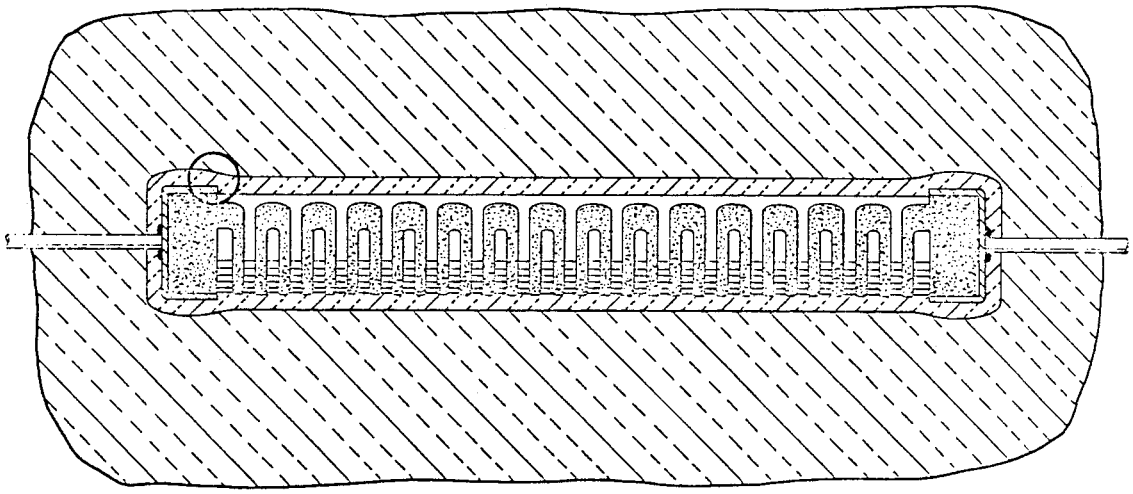
FIG. 1. (PRIOR ART)
FIG. 1 is a view showing a prior-art high-voltage cylindrical film-type resistor embedded in an epoxy or other potting compound, the core of the resistor being shown in side elevation, the end caps and surrounding environmental coating being shown in section.
Figure 2:
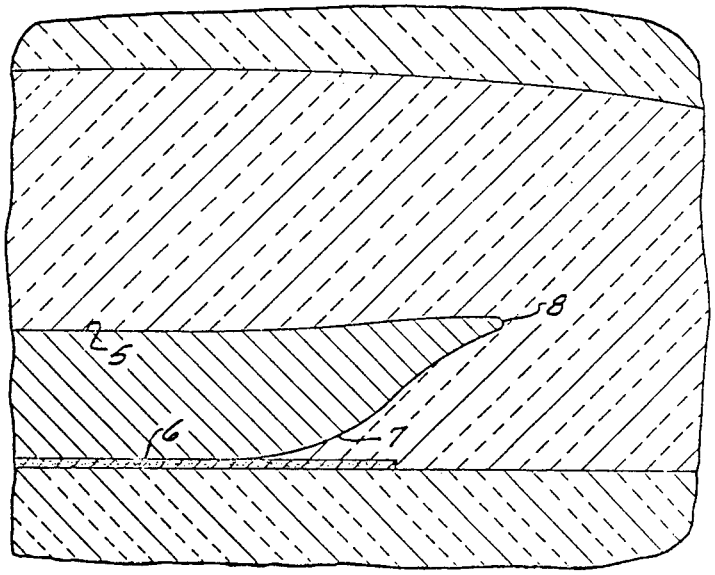
FIG. 2. (PRIOR ART)
FIG. 2 is a greatly-enlarged fragmentary view, also showing prior art, illustrating a region of the resistor of FIG. 1 that is near a circle drawn at the left-upper portion of such FIG. 1.
Figure 3:
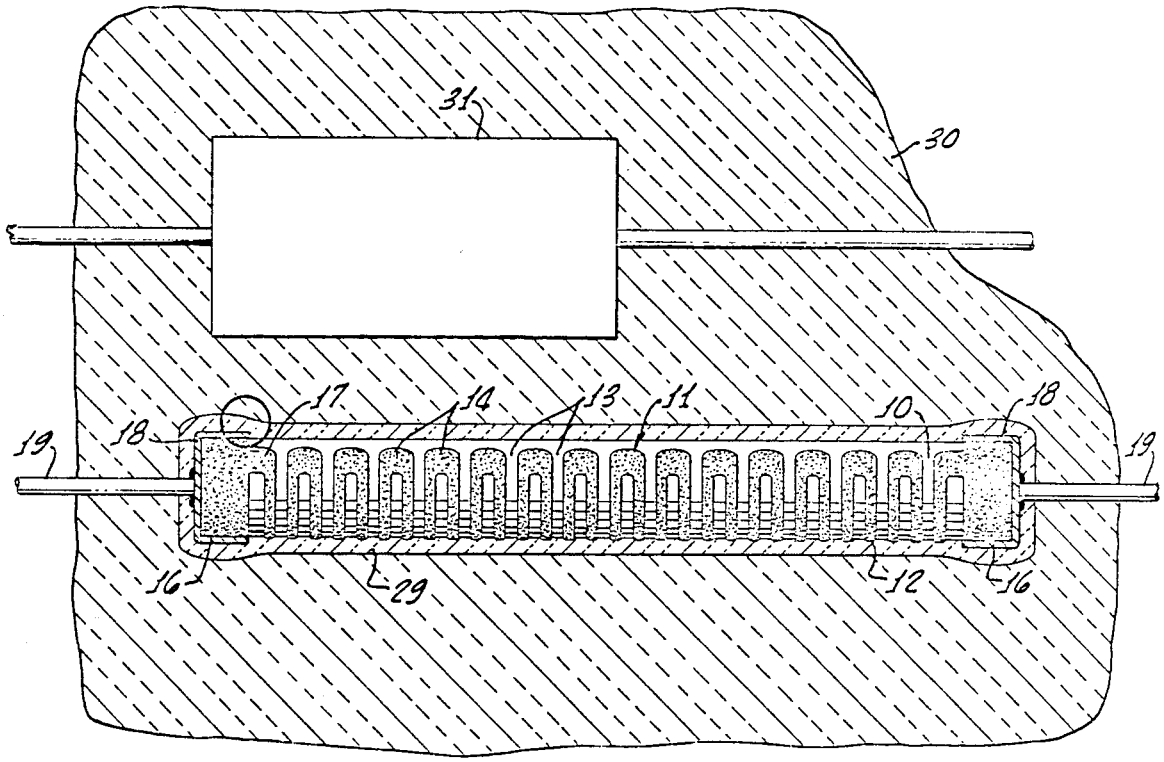
FIG. 3 is a view corresponding to FIG. 1 but showing the present high-voltage resistor, and also showing in the potting compound an adjacent capacitor or other component in the circuit of which the high-voltage resistor forms a part.

Referring to FIGS. 1 and 2 of the present patent application, both of which figures show prior art, a high-voltage resistor substantially corresponding to the one shown in FIG. 1 of U.S. Pat. No. 4,132,971, and coated with an environmental coating as shown in FIG. 3 of U.S. Pat. No. 3,858,147, is illustrated as being potted in an epoxy or other potting material. The greatly enlarged view of FIG. 2 of the present application illustrates in longitudinal section the rim portion of the sidewall of the cup-shaped metal end cap at each end of the resistor.

As shown in FIG. 2, each end cap has outer and inner cylindrical sidewall surfaces 5 and 6, respectively. The outer surface 5 continues for substantially the entire distance to the extreme edge of the rim, except for some flaring, while the inner sidewall surface 6 flares markedly in the region 7. Stated in another way, the region 7 is divergent in a direction toward the end cap at the other end of the resistor, such region 7 being a surface of revolution about the axis of the resistor and being generally frustoconical. The frustoconical region or surface 7 produces the benefit of aiding in insertion of the resistor core into the end cap, this being a press-fitting operation.

The edge 8 formed where the generally cylindrical sidewall 5 meets the generally frustoconical region or surface 7 is quite sharp, and from it there emanates a relatively strong (high field stress or voltage gradient) corona or electrical discharge that the environmental coating (such as silicone conformal) and the surrounding potting material attempt to contain. However, such containment is a distinct problem, especially when the resistor is incorporated in a satellite and other place where the requirements for compactness and resistance to thermal shock are severe.

As previously indicated, the corona can generate strange and unpredictable results, one of which is tunneling. Once one (or more) tunnel starts, for example from edge 8, it frequently follows a path through the environmental coating and into the potting compound. From there, it may over a period of time, such as years, penetrate to an adjacent circuit component (for example, a capacitor). Alternatively, the tunnel may pass through the environmental layer and into the potting compound and then circle back through the potting compound and the environmental coating until it engages a portion of the resistive film on the resistor core itself. Such engagement is usually at a region relatively close to the end cap although it can be spaced a considerable distance therefrom.

When the tunnel reaches an adjacent component it can cause a breakdown of the circuit. When the tunnel reaches a portion of the same resistor from which the tunnel emanated, it can cause severe degradation of the resistive film in the vicinity of the tunnel end. For example, the resistive film stops having a generally glassy appearance and instead becomes pitted and somewhat granular. This can adversely affect circuit performance.

Referring to FIG. 3, the present resistor comprises an elongated cylinder 10 (the substrate) formed of electrically insulating material, preferably a suitable heat-resistant ceramic such as aluminum oxide. Provided exteriorly on cylinder 10, in adherent relationship relative to the cylindrical surface, is a resistive film 11. The film comprises an elongated strip 12 which is shaped in a noninductive serpentine pattern as illustrated.

Although the resistive film extends around at least a majority of the circumference of the cylinder 10, and is present at major areas of the surface of such cylinder, it is not present along a longitudinal gap 13 which extends for the full length of cylinder 10 parallel to the axis thereof. The gap 13 is sufficiently wide that there will not be any voltage breakdown between portions of film 11 on opposite sides of the gap.

The film pattern is, very preferably, silk screened onto the substrate. It comprises a multiplicity of series-related hairpin-shaped portions each having a U-shaped bend or base (turn) 14 and also having parallel arms. Adjacent arms pass current in opposite directions, the result being that the generated magnetic fields efficiently neutralize each other to prevent the creation of substantial inductance in the resistor.

The U-shaped bend or base portions 14 of the resistive film are disposed in two parallel rows, one row on each side of gap 13, each row extending substantially axially of the cylindrical substrate. The arms thus extend circumferentially of the cylindrical surface, whereas at least portions of the bases (bends) extend longitudinally thereof.

In the preferred form, the bend or base regions 14 are caused to be much wider than are the various arms, it being noted that the width of each arm is measured in the direction longitudinal of the resistor, whereas the width of each bend or base 14 is measured in the direction circumferential to the resistor.

At opposite ends of the serpentine strip 12 of resistive film are terminal portions 17 of such film, which portions preferably extend parallel to the axis of cylinder 10 and adjacent (but not in) gap 13. The terminal portions 17 are electrically and physically in contact with highly conductive cylindrical films 16 provided on the cylindrical substrate at its ends.

Metal end caps 18, shaped as cups having cylindrical sidewalls and radial bottom walls, are press-fit over the ends of cylinder 10, that is to say over the cylindrical highly-conductive films 16 at such ends. Electrical contact is thus formed, effectively, with conductive films 16 and thus with terminal portions 17. Axial leads 19 extend outwardly from the end caps 18, being electrically and physically connected to such end caps by suitable means.

Figure 4:
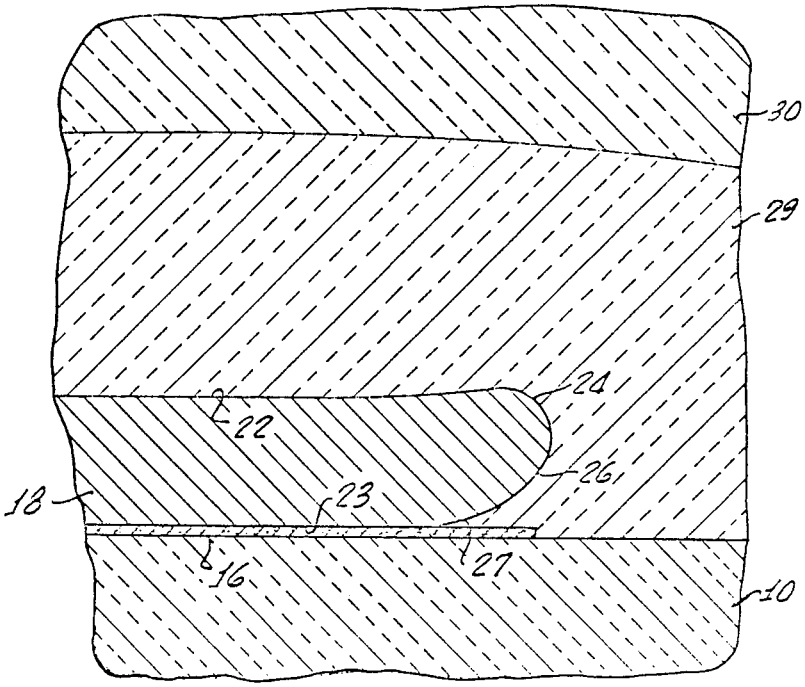
FIG. 4 is a view corresponding to FIG. 2 but showing a part of the present resistor, in greatly enlarged form, near the encircled region of FIG. 3.

Referring to FIG. 4, each end cap 18 has outer and inner cylindrical sidewall surfaces 22 and 23, respectively, the inner surface 23 being in press-fit engagement with the conductive film 16 on the cylindrical substrate. The outer sidewall surface 22 of the cap terminates at the rim of the cap in a convexly rounded region 24, while the inner sidewall surface 23 also terminates in a convexly rounded region 26. The latter rounded region merges with a generally frustoconical region 27 that diverges in a direction toward the end cap at the opposite end of the resistor.

The rounded regions 24, 26 have a radius of curvature much larger than any radius that might be present at edge 8 (FIG. 2) Each such radius, and the indicated roundnesses, are in any plane containing the axis of substrate or core 10.

Because of this radius, shown in FIG. 4, the electrical discharge or corona, incident to the high voltage (such as 1000 or more volts) present in the resistor, is greatly reduced in strength (field stress). This is done without the necessity for any shielding of any part, or for any increase in the diameter of the resistor with consequent lessening of the compactness of the over-all electrical circuit of which the resistor forms a component.

The generally frustoconical region 27 shown in FIG. 4, and the adjacent rounded region 26, cooperate to aid in the press-fitting of the resistor core 10 into the end cap, so that this operation is not substantially different than has been done for a long time relative to end caps the rims of which are shaped, for example, like what is shown in FIG. 2.

The present invention provides a convex radius of the rim of each end cap (in a plane containing the axis of the resistor) of at least 1.5 mils and preferably 2.5 mils or more. The maximum field-stress gradient is thus reduced to a small fraction of the field-stress gradient generated at the end cap rim shown in FIG. 2.

The wall thickness (each side) of the cylindrical sidewall of each metal end cap is in the range of 5 to 30 mils, and is preferably about 8 mils to about 10 mils. The convex radius at the rim of each end cap is preferably at least one-fourth such wall thickness.

There is shown in FIGS. 3 and 4 the environmental coating 29 of silicone conformal or other suitable material. The thickness of coating 29 is preferably about 15 mils on each side of the resistor. Coating 29 is preferably applied in two or more layers so as to reduce the possibility that any pinholes in one layer will register with pinholes in another layer, thus creating breakdown paths.

The silicone conformal has a coefficient of thermal expansion which is compatible with that of the ceramic substrate 10 and of the resistive film 11 thereon. Accordingly, the coating 29 serves as a buffer between the resistive film and the surrounding potting material 30 formed of an epoxy compound or other suitable substance having a high dielectric strength. For example, the potting material may have a dielectric strength of 300 volts per mil.

There is shown in FIG. 3 another component in the same circuit as that in which the present resistor is incorporated, the illustrated other component being a capacitor 31. Because of the present invention, the capacitor 31 or other circuit component may be placed relatively close to the present resistor, without substantial danger that there will be tunnels created by coronas, even over a period of several years. Also, there is no substantial danger that there will be tunneling from one portion of the present resistor to another portion thereof, with consequent degradation of a portion of the resistive film as described above.

It is emphasized that the present invention makes it possible to have less perfect potting and coating layers while still preventing any substantial likelihood of corona-induced damage or breakdown. In the past, it has been critical that the encapsulants be substantially perfectly bubble-free, and for this reason there were uses of vacuum and pressure during the potting operations. Such vacuum and pressure operations should still continue, but in the event that they do not produce substantially perfect results—so that there are bubbles which are regions of low dielectric strength—the tendency toward tunneling and breakdown is markedly reduced vis-a-vis prior-art structures.

Similarly, the present invention is more forgiving of generation of shear forces between the layer or coating 29 and the surrounding potting material 30. Such shear-force regions tend to create breakdown areas, but these breakdown areas are less likely to create failure because of the lessened corona generation resulting from use of the present invention.

The environmental coating 29 is not only physically but chemically compatible with the resistive film of the resistor, in that it will not chemically degrade the resistive film in any way.

Figure 5:
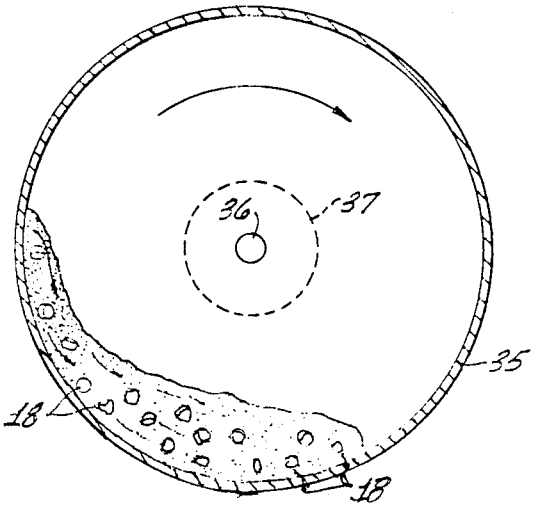
FIG. 5 is a view schematically illustrating the tumbling of the metal end caps prior to press-fitting such caps into the ends of the resistor cores.

Proceeding next to a description of the method of the invention, applicant has discovered that the best way to create the radiuses indicated in FIG. 4, and described relative thereto, is by abrading. Stated more specifically, the radiuses are created by tumbling. A typical tumbling apparatus is shown in FIG. 5, and has a drum 35 that contains large numbers of end caps 18 in a conventional abrading medium. The drum is rotated about shaft 36 by a motor 37 which drives such shaft. The tumbler is operated for a long time, for example, 24 hours, to round off the edges of the rims sufficiently to change them from the FIG. 2 configuration (typically) to the configuration of FIG. 4 (typically).

The thus-tumbled end caps are then press-fit over the ends of the resistor cores, such resistor cores having been formed previously as described in detail in both of the above-cited patents. Thereafter, the layers of silicone conformal or other suitable environmental-protective coating or buffer are applied. Then, the resistor is sent to the customer who incorporates it in an electric circuit and typically pots the circuit by use of a potting material such as is indicated at 30.

There has thus been produced a resistor and method capable of greatly increasing reliability, with no increase and size and little increase in cost.

Although it is preferred that the present resistors be of the thick-film type as described in the above-cited patents, the present invention is also applicable to thin-film resistors.

The foregoing detailed description is to be clearly understood as given by way of illustration and example only, the spirit and scope of this invention being limited solely by the appended claims.

What is claimed is:

1. A high-voltage resistor, comprising:

(a) an elongate insulating substrate having a cylindrical exterior surface, (b) a resistive film adherently provided on said exterior surface, and (c) electrically highly conductive end caps mounted coaxially on the ends of said substrate in electrical contact with said resistive film, said end caps being generally cup-shaped and having the substrate ends inserted therein, the rims of said end caps being convexly radiused in planes that contain the axis of said substrate, the radius of said rims in said planes being at least 1.5 mils so as to decrease the field strengths of the coronas that emanate from said rims.

2. The invention as claimed in claim 1, in which said radius is at least 2.5 mils.

3. The invention as claimed in claim 1, in which said radius is at least one-fourth the thickness of the sidewall of each end cap, and in which said sidewall thickness is in the range of 5 mils to 30 mils.

4. The invention as claimed in claim 1, in which said radius is formed by abrading said rims of said end caps prior to mounting said end caps on said substrate.

5. The invention as claimed in claim 4, in which said radius is formed by tumbling said end caps prior to mounting said end caps on said substrate.

6. The invention as claimed in claim 1, in which said substrate, resistive film and end caps are coated, after assembly, with an environmentally protective coating.

7. A high-voltage resistor, comprising:

(a) an elongate ceramic cylinder, (b) a resistive film adherently provided on the exterior cylindrical surface of said cylinder, (c) cup-shaped end caps press-fit coaxially onto opposite ends of said cylinder in electrical contact with termination portions of said resistive film, said end caps being formed of metal, the rims of said end caps being convexly radiused in planes that contain the axis of said cylinder, the radius of said rims in said planes being at least 1.5 mils so as to decrease the field strengths of the coronas that emanate from said rims, and (d) an environmentally-protective encapsulant coating coated around said end caps, film and cylinder.

8. The invention as claimed in claim 7, in which said radius is at least 2.5 mils.

9. The invention as claimed in claim 7, in which said radius is at least one-fourth the thickness of the sidewall of each end cap, and in which said sidewall thickness is in the range of 5 mils to 30 mils.

10. The invention as claimed in claim 7, in which said radius is formed by abrading said rims of said end caps prior to mounting said end caps on said substrate.

11. The invention as claimed in claim 10, in which said radius is formed by tumbling said end caps prior to mounting said end caps on said substrate.

12. The invention as claimed in claim 7, in which said resistive film is a film that has been silk-screened onto said cylinder in a noninductive serpentine pattern.

13. The invention as claimed in claim 7, in which said encapsulated resistor is embedded in a mass of potting compound, said mass containing at least one circuit component additional to said high-voltage resistor.

14. The invention as claimed in claim 7, in which each of said end caps is a cup formed by deep drawing and then shearing, said deep drawing and shearing causing a generally frustoconical interior surface of said rim adjacent the extreme edge thereof, said interior surface aiding in the press fitting of said caps onto said cylinder, and in which said caps have been tumbled to form said radius without destroying a large part of said generally frustoconical surface, said tumbling having been continued for much longer than was required for deburring, and sufficiently long to achieve said radius.

15. A method of manufacturing a high-voltage resistor characterized by relatively low-strength corona discharge, which comprises:

(a) forming metal end caps that are generally cup shaped, (b) abrading said end caps much more than necessary to remove any burrs from the rims thereof, said abrading being continued sufficiently long to increase substantially the radius of each cap rim in any plane containing the axis of said cup, said abrading step being continued sufficiently long to increase each of said end-cap rim radiuses in said plane to at least 1.5 mils, and (c) mounting said caps over the ends of a cylindrical substrate having a resistive film thereon, in electrical contact with said film.

16. The invention as claimed in claim 15, in which said abrading is effected by tumbling.

* * * * *